US006313820B1

(12) United States Patent
Helbing et al.

(10) Patent No.: US 6,313,820 B1
(45) Date of Patent: Nov. 6, 2001

(54) METHOD OF OPERATING A FERROELECTRIC LIQUID CRYSTAL SPATIAL LIGHT MODULATOR IN NON-DC BALANCED MODE WITH DECREASED PIXEL STICKING

(75) Inventors: Rene P. Helbing, Palo Alto; Mark M. Butterworth, Santa Clara, both of CA (US)

(73) Assignee: Hewlett-Packard Co., Palo Alto, CA (US)

( * ) Notice: Subject to any disclaimer, the term of this patent is extended or adjusted under 35 U.S.C. 154(b) by 0 days.

(21) Appl. No.: 09/239,597

(22) Filed: Jan. 29, 1999

(51) Int. Cl.[7] ..... G09G 3/36
(52) U.S. Cl. ..... 345/96; 345/97
(58) Field of Search ..... 345/94, 96, 97, 345/95, 48, 84; 349/25, 172, 21, 161, 171

(56) References Cited

U.S. PATENT DOCUMENTS

| | | | | |
|---|---|---|---|---|
| 5,436,742 | * | 7/1995 | Tanaka et al. | 359/56 |
| 5,731,797 | * | 3/1998 | Akiyama et al. | 345/97 |
| 5,990,853 | * | 11/1999 | Kuratomi et al. | 345/48 |
| 6,016,173 | * | 1/2000 | Crandall | 349/25 |
| 6,091,463 | * | 7/2000 | Robinson et al. | 349/25 |

* cited by examiner

*Primary Examiner*—Steven Saras
*Assistant Examiner*—Fritz Alphonse

(57) ABSTRACT

A method of operating a ferroelectric liquid crystal-based spatial light modulator in a non-DC-Balanced mode to delay the onset of pixel sticking. The method includes providing a spatial light modulator including a transparent electrode, a pixellated electrode, and a ferroelectric liquid crystal layer sandwiched between the transparent electrode and the pixellated electrode. The spatial light modulator is illuminated with a light source for an illumination time. A portion of the pixellated electrode is set to a high drive signal voltage level during a first portion of illumination time, and set to a low drive signal voltage level during a second portion of the illumination time. The transparent electrode is maintained at a first voltage potential between the high drive signal voltage level and the low drive signal voltage level during the first and second portions of illumination time. The spatial light modulator is then darkened for a darkened time. The transparent electrode voltage potential is raised to a positive spiking voltage exceeding the first voltage potential for a first portion of the darkened time. The transparent electrode voltage potential is then lowered to a negative spiking voltage below the first voltage potential for a second portion of the darkened time. The method according to the invention then repeats itself beginning with the step of illuminating the spatial light modulator.

16 Claims, 7 Drawing Sheets

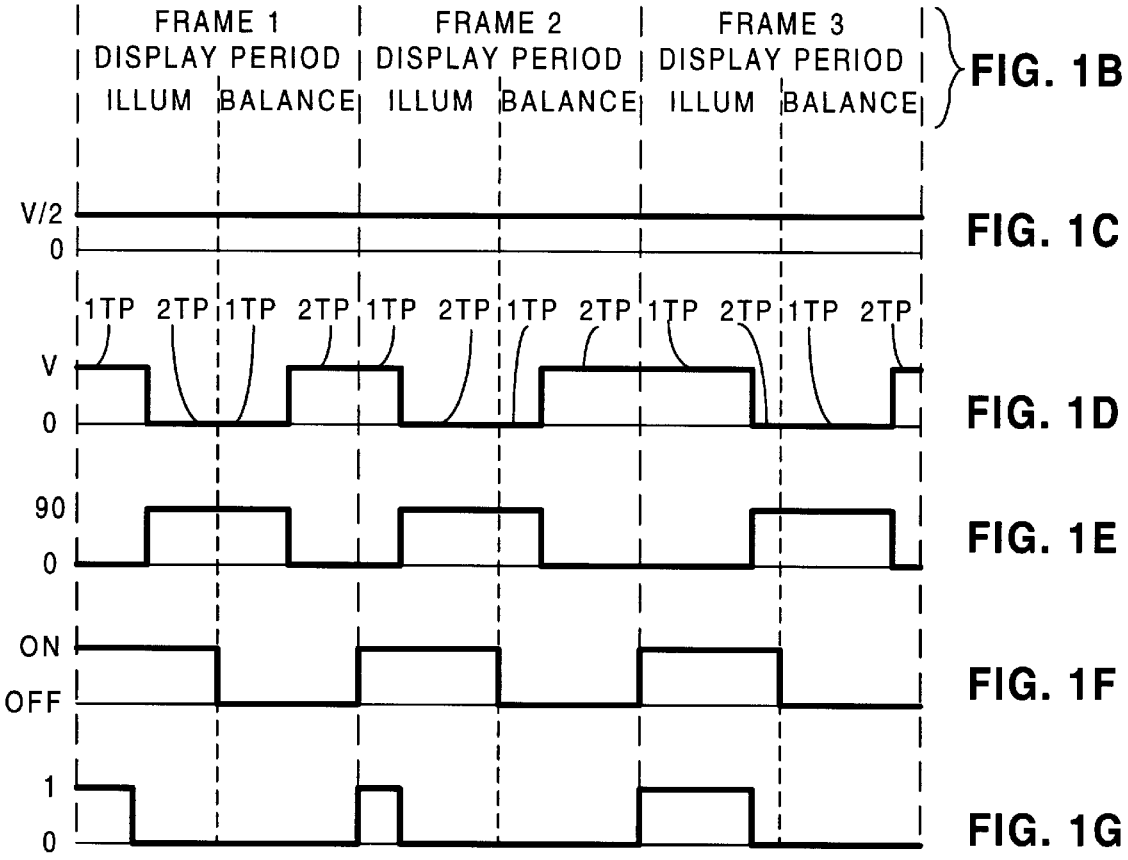
(PRIOR ART)

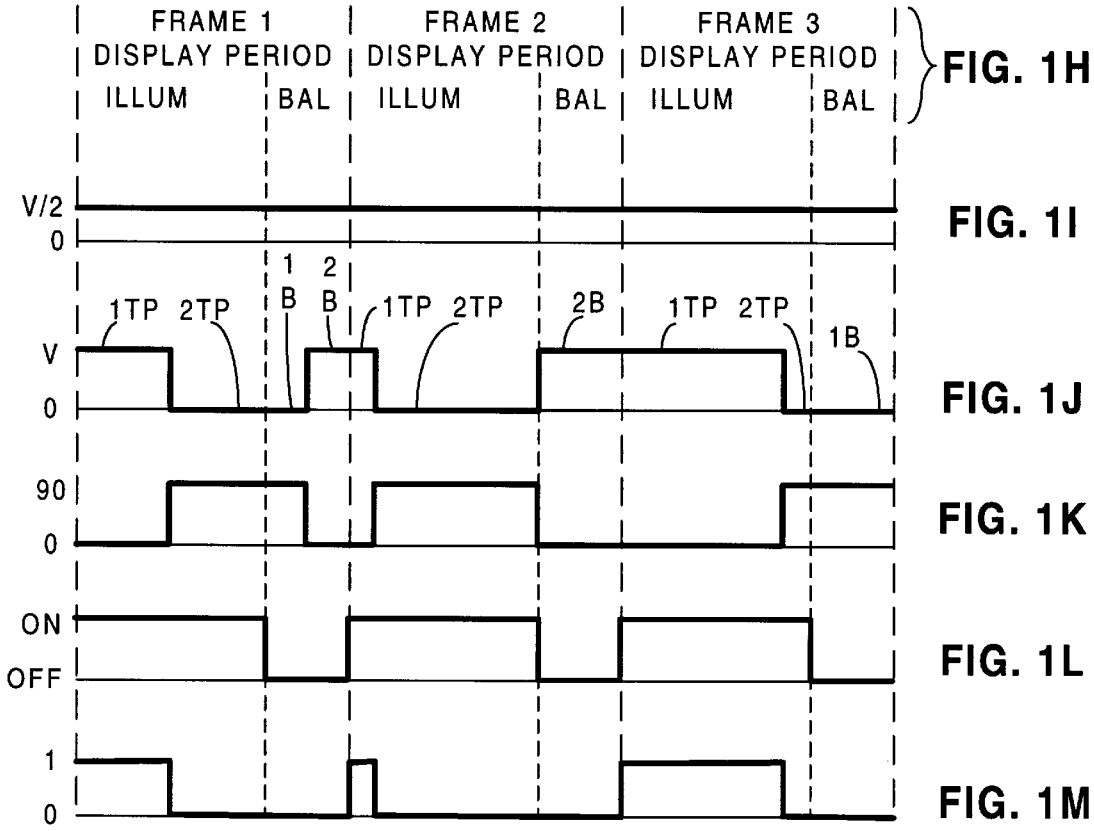
(PRIOR ART)

FRAME 1
ILLUMINATION
SPIKE
FRAME 2
ILLUMINATION
SPIKE
FRAME 3
ILLUMINATION
SPIKE
1TP
2TP
1TP
2TP
1TP
2TP
V1
V/2
0
-V1
V
0
90
0
ON
OFF
1
0

METHOD OF OPERATING A FERROELECTRIC LIQUID CRYSTAL SPATIAL LIGHT MODULATOR IN NON-DC BALANCED MODE WITH DECREASED PIXEL STICKING

FIELD OF THE INVENTION

The invention relates to ferroelectric liquid crystal-based spatial light modulators such as those used in video displays and in particular relates to such spatial light modulators operated in a Non-DC-balanced mode.

BACKGROUND OF THE INVENTION

A need exists for various types of video and graphics display devices with improved performance and lower cost. For example, a need exists for miniature video and graphics display devices that are small enough to be integrated into a helmet or a pair of glasses so that they can be worn by the user. Such wearable display devices would replace or supplement the conventional displays of computers and other devices. A need also exists for a replacement for the conventional cathode-ray tube used in many display devices including computer monitors, conventional and high-definition television receivers and large-screen displays. Both of these needs can be satisfied by display devices that incorporate a light valve that uses as its light control element a spatial light modulator based on a ferroelectric liquid crystal (FLC) material.

FLC-based spatial light modulators are available in either a transmissive form or in a reflective form. The transmissive spatial light modulator is composed of a layer of a FLC material sandwiched between two transparent electrodes. The FLC material is preferably a surface-stabilized FLC material. One of the electrodes is segmented into an array of pixel electrodes to define the picture elements (pixels) of the transmissive spatial light modulator. The direction of an electric field applied between each pixel electrode and the other electrode determines whether or not the corresponding pixel of the transmissive spatial light modulator rotates the direction of polarization of light falling on the pixel. The transmissive spatial light modulator is constructed as a half-wave plate and rotates the direction of polarization through 90° so that the polarized light transmitted by the pixels of the spatial light modulator either passes through a polarization analyzer or is absorbed by the polarization analyzer, depending on the direction of the electric field applied to each pixel.

Reflective spatial light modulators are similar in construction to transmissive spatial light modulators, but use reflective pixel electrodes and have the advantage that they do not require a transparent substrate. Accordingly, reflective spatial light modulators can be built on a silicon substrate that also accommodates the drive circuits that derive the drive signals for the pixel electrodes from the input video signal. A reflective light valve has the advantage that its pixel electrode drive circuits do not partially occlude the light modulated by the pixel. This enables a reflective light valve to have a greater light throughput than a similar-sized transmissive light valve and allows larger and more sophisticated drive circuits to be incorporated.

As with the transmissive spatial light modulators, the direction of an electric field (in this case between the transparent electrode and the reflective electrode) determined whether or not the corresponding pixel of the reflective spatial light modulator rotates through 90° the direction of polarization of the light falling on (and reflected by) by the pixel. Thus, the polarized light reflected by the pixels of the reflective spatial light modulator either passes through a polarization analyzer or is absorbed by the polarization analyzer, depending on the direction of the electric field applied to each pixel.

The resulting optical characteristics of each pixel of both the transmissive and reflective spatial light modulators are binary: each pixel either transmits light (its 1 state) or absorbs light (its 0 state), and therefore appears light or dark, depending on the direction of the electric field.

To produce the grey scale required for conventional display devices, the apparent brightness of each pixel is varied by temporally modulating the light transmitted by each pixel. The light is modulated by defining a basic time period that will be called the illumination period of the spatial light modulator. The pixel electrode is driven by a drive signal that switches the pixel from its 1 state to its 0 state. The duration of the 1 state relative to the duration of the illumination period determines the apparent brightness of the pixel.

Ferroelectric liquid crystal-based spatial light modulators (both transmissive and reflective) suffer the disadvantage that, after each time the drive signal has been applied to a pixel electrode to cause the pixel to modulate the light passing through it, the DC balance of the pixel must be restored or a condition called "pixel sticking" will eventually result. Pixel sticking is a condition where a pixel will not change states despite a change in the direction of an electric field applied between a pixel electrode and the other electrode. Mild pixel sticking is comparable to ghost images sometimes seen on CRT screens that have had one image displayed for too long.

When operated in the DC-balanced mode, pixel sticking is not problematic. This is done by defining a second basic time period called the balance period, equal in duration to the illumination period, and driving the pixel electrode with a complementary drive signal having 1 state and 0 state durations that are complementary to the 1 state and 0 state durations of the drive signal during the illumination period. The illumination period and the balance period collectively constitute a display period. To prevent the complementary drive signal from causing the display device to display a substantially uniform, grey image, the light source illuminating the light valve is modulated so that the light valve is only illuminated during the illumination period, and is not illuminated during the balance period. However, modulating the light source as just described reduces the light throughput of the light valve to about half of that which could be achieved if DC-balance restoration were unnecessary. This means that a light source of approximately twice the intensity, with a corresponding increase in cost, is necessary to achieve a given display brightness. Additionally or alternatively, projection optics with a greater aperture, also with a corresponding increase in cost, are necessary to achieve a given brightness.

FIG. 1A shows part of a display device incorporating a conventional reflective light valve 10 that includes the reflective spatial light modulator 12. Other principal components of the light valve are the polarizer 14, the beam splitter 16 and the analyzer 18. The light valve is illuminated with light from the light source 20, the efficiency of which may be improved using a reflector 22 and collector optics 24 that concentrate the light towards the polarizer 14. The light output by the light valve passes to the output optics 26 that focus the light to form an image (not shown). The light valve, light source (including reflector and collector optics)

and output optics may be incorporated into various types of display device, including miniature, wearable devices, cathode-ray tube replacements, and projection displays.

Light generated by the light source 20 passes through the polarizer 14. The polarizer polarizes the light output from the light source. The beam splitter 16 reflects a fraction of the polarized light output from the polarizer towards the spatial light modulator 12. The spatial light modulator is divided into a two-dimensional array of picture elements (pixels) that define the spatial resolution of the light valve. The beam splitter transmits a fraction of the light reflected by the spatial light modulator to the analyzer 18.

The direction of an electric field in each pixel of the spatial light modulator 12 determines whether or not the direction of polarization of the light reflected by the pixel is rotated by 90° relative to the direction of polarization of the incident light. The light reflected by each pixel of the spatial light modulator passes through the beam splitter 16 and the analyzer 18 and is output from the light valve depending on whether or not its direction of polarization was rotated by the spatial light modulator. The light output from the light valve 10 passes to the output optics 26.

The light source 20 may be composed of LEDs. The LEDs are of three different colors in a color display. Other light-emitting devices whose output can be rapidly modulated may alternatively be used as the light source 20. As a further alternative, a white light source and a light modulator (not shown) may be used. The light modulator modulates the amplitude of the light generated by the light source to define the illumination period and balance period of the spatial light modulator. In a light valve for use in a color display device, the light modulator additionally modulates the color of the light output from the light source.

The polarizer 14 polarizes the light generated by the light source 20. The polarization is preferably linear polarization. The beam splitter 16 reflects the polarized light output from the polarizer towards the spatial light modulator 12, and transmits to the analyzer 18 the polarized light reflected by the spatial light modulator. The direction of maximum transmission of the analyzer is orthogonal to that of the polarizer in this example.

The spatial light modulator 12 is composed of the transparent electrode 28 deposited on the surface of the transparent cover 30, the reflective electrode 32 located on the surface of the semiconductor substrate 34, and the ferroelectric liquid crystal layer 36 sandwiched between the transparent electrode and the reflective electrode. The reflective electrode is divided into a two-dimensional array of pixel electrodes that define the pixels of the spatial light modulator and of the light valve. A substantially reduced number of pixel electrodes are shown to simplify the drawing. For example, in a light valve for use in a large-screen computer monitor, the reflective electrode could be divided into a two-dimensional array of 1600×1200 pixel electrodes. An exemplary pixel electrode is shown at 38. Each pixel electrode reflects the portion of the incident polarized light that falls on it towards the beam splitter 16.

A drive circuit (not shown), which may be located in the semiconductor substrate 34, applies a drive signal to the pixel electrode of each pixel of the spatial light modulator 12. The drive signal has two different voltage levels, and the transparent electrode 28 is maintained at a fixed potential mid-way between the voltage levels of the drive signal. The potential difference between the pixel electrode and the transparent electrode establishes an electric field across the part of the liquid crystal layer 36 between the pixel and transparent electrodes. The direction of the electric field determines whether the liquid crystal layer rotates the direction of polarization of the light reflected by the pixel electrode, or leaves the direction of polarization unchanged.

The reflective spatial light modulator 12 is structured as a quarter-wave plate in contrast to a transmissive spatial light modulator, which is structured as a half-wave plate. This difference arises because light passes through the reflective spatial light modulator twice, once before and once after reflection by the reflective pixel electrodes. The thickness of the layer of ferroelectric liquid crystal material in the liquid crystal layer 36 is chosen to provide an optical phase shift of 90° between light polarized parallel to the director of the liquid crystal material and light polarized perpendicular to the director. The liquid crystal material is preferably a Smectic C* surface stabilized ferroelectric liquid crystal material having an angle of 22.5° between its director and the normal to its smectic layers. Reversing the direction of the electric field applied to such a liquid crystal material switches the director of the material through an angle of about 45°. Consequently, if the director is aligned parallel to the direction of maximum transmission of the analyzer 18 with one polarity of the electric field, reversing the direction of the electric field will rotate the direction of polarization of light reflected by the pixel through 90°. This will align the direction of polarization of the light perpendicular to the direction of maximum transmission of the analyzer, and will change the pixel from its 1 state, in which the pixel appears bright, to its 0 state, in which the pixel appears dark.

In a miniature, wearable display, the output optics 26 are composed of an eyepiece that receives the light reflected by the reflective electrode 32 and forms a virtual image at a predetermined distance in front of the user (not shown). In a cathode-ray tube replacement or in a projection display, the output optics are composed of projection optics that focus an image of the reflective electrode on a transmissive or reflective screen (not shown). Optical arrangements suitable for use as an eyepiece or projection optics are well known in the art and will not be described here.

Since the direction of maximum transmission of the analyzer 18 is orthogonal to the direction of polarization defined by the polarizer 14, light whose direction of polarization has been rotated through 90° by a pixel of the spatial light modulator 12 will pass through the analyzer and be output from the light valve 10 whereas light whose direction of polarization has not been rotated will not pass through the analyzer. The analyzer only transmits to the output optics 26 light whose direction of polarization has been rotated by pixels of the spatial light modulator. The pixels of the spatial light modulator will appear bright or dark depending on the direction of the electric field applied to each pixel. When a pixel appears bright, it will be said to be in its 1 state, and when the pixel appears dark, it will be said to be in its 0 state.

The direction of maximum transmission of the analyzer 18 can alternatively be arranged parallel to that of the polarizer 14, and a non-polarizing beam splitter can be used as the beam splitter 16. In this case, the spatial light modulator 12 operates in the opposite sense to that just described.

To produce the grey scale required by a display device notwithstanding the binary optical characteristics of the pixels of the light valve 10, the apparent brightness of each pixel is varied by temporally modulating the light reflected by the pixel, as described above. The drive circuit (not shown) for each pixel of the spatial light modulator determines the duration of the 1 state of the pixel in response to a portion of the input video signal 40 corresponding to the location of the pixel in the spatial light modulator.

FIGS. 1B–1G illustrate the operation of the exemplary pixel 38 of the conventional light valve 10 shown in FIG. 1 A operating in a DC-balanced mode during three consecutive display periods. The remaining pixels operate similarly. In one embodiment of a conventional light valve, each display period corresponded to one frame of the input video signal 40. In another embodiment, each display period corresponded to a fraction of one frame of the input video signal. Each display period is composed of an illumination period (ILLUM) and a balance period (BALANCE) having equal durations, as shown in FIG. 1B.

FIG. 1C shows the bias voltage level applied to the transparent electrode 28. In this case, the bias voltage level is kept at a constant level of V/2, so that the changing the voltage applied to the exemplary pixel electrode 38 (as shown in FIG. 1D) from 0 to V reverses the direction of the electric field applied to the ferroelectric liquid crystal layer 36. The level of the drive signal is V for a first temporal portion 1TP of each illumination period. The level of the drive signal is 0 for the second temporal portion 2TP constituting the remainder of the illumination period, and also for the first temporal portion 1TP of the subsequent balance period. The first temporal portion of the balance period has a duration equal to the first temporal portion of the illumination period. However, the level of the drive signal is 0 during the first temporal portion of the balance period, whereas the level of the drive signal is V during the first temporal portion of the illumination period. Finally, the level of the drive signal changes to V for the second temporal portion 2TP constituting the remainder of the balance period. Consequently, during the balance period, the level of the drive signal is 0 and V for times equal to the times that it was at V and 0, respectively, during the illumination period. As a result, the electric field applied to the liquid crystal material of the pixel averages to zero over the display period.

In the example shown, the duration of the first temporal portion 1TP of the drive signal is different in each of the three illumination periods. The duration of the first temporal portion, and, hence, of the second temporal portion, of each illumination period depends on the voltage level of the corresponding sample of the input video signal 40.

FIG. 1E shows the effect of the spatial light modulator 12 on the direction of polarization of the light impinging on the analyzer 18. The direction of polarization is indicated by the absolute value of the angle $\alpha$ between direction of polarization of the light impinging on the analyzer and the direction of maximum transmissivity of the analyzer. The analyzer transmits light having an angle $\alpha$ close to zero and absorbs light having an angle $\alpha$ close to 90°. In each display period, the angle $\alpha$ a has values corresponding to the pixel being bright and dark for equal times due to the need to restore the DC-balance of the pixel.

FIG. 1F shows the modulation of the light source 20. The light source is ON throughout the illumination period of each display period, and is OFF during the following balance period.

FIG. 1G shows the light output from the exemplary pixel of the light valve 10 controlled by the pixel electrode 38. Light is output from the pixel only during the first temporal portion of the illumination period of each display period. No light is output during the second temporal portion of the illumination period. Moreover, no light is output during the balance period of the display period because the light source 20 is OFF during the balance period. The light source being OFF for half the display period substantially reduces the perceived maximum brightness of the pixel, and of any image generated by a display device incorporating such a conventional light valve.

FIGS. 1H–1M illustrate the operation of the exemplary pixel 38 of the conventional light valve 10 shown in FIG. 1A operating in a non-DC-balanced mode with a illumination period (ILLUM) that is 70% of the display period and a balance period (BAL) that is 30% of the display period for three consecutive display periods as shown in FIG. 1H. The remaining pixels operate similarly. In one embodiment of a conventional light valve, each display period corresponded to one frame of the input video signal 40. In another embodiment, each display period corresponded to a fraction of one frame of the input video signal.

FIG. 1I shows the bias voltage level applied to the transparent electrode 28. In this case, the bias voltage level is kept at a constant level of V/2, so that the changing the voltage applied to the exemplary pixel electrode 38 (as shown in FIG. 1J) from 0 to V reverses the direction of the electric field applied to the ferroelectric liquid crystal layer 36.

The level of the drive signal is V for a first temporal portion 1TP of each illumination period. The level of the drive signal is 0 for the second temporal portion 2TP constituting the remainder of the illumination period. If the difference between the length of the first temporal portion 1TP and the second temporal portion 2TP is less than the duration of the balance period, then the balance period will be divided into a first balance portion 1B and a second balance portion 2B. The level of the drive signal is 0 for the first balance portion 1B and the level of the drive signal is V for the second balance portion 2B constituting the duration of the balance period.

The difference in the duration of the first balance portion 1B to the second balance portion 2B will be equal to the difference between the length of the first temporal portion 1TP and the second temporal portion 2TP. If the first temporal portion 1TP was larger than the second temporal portion 2TP then the first balance portion 1B will be larger than second balance portion 2B. Consequently, during the balance period, the difference in duration between when the level of the drive signal is 0 and when the level of the drive signal is V exactly offsets the difference in duration between when the level of the drive signal is 0 and when the level of the drive signal is V during the illumination period. As a result, the electric field applied to the liquid crystal material of the pixel averages to zero over the display period.

In the example shown, the duration of the first temporal portion 1TP of the drive signal is different in each of the three illumination periods. In Frame 2, the duration of the first temporal portion 1TP is short compared to the duration of the second temporal portion 2TP. The difference between the duration of the first temporal portion and the second temporal portion is greater than the duration of the balance period. As a result the entire balance period is set as a second balance portion 2B, but the entire display period nevertheless remains unbalanced with the total duration when the level of drive signal is at level 0 exceeding the total duration when the level of the drive signal is at level V.

In Frame 3, the duration of the first temporal portion 1TP is long compared to the duration of the second temporal portion 2TP. The difference between the duration of the first temporal portion and the second temporal portion is greater than the duration of the balance period. As a result the entire balance period is set as a first balance portion 1B, but the entire display period nevertheless remains unbalanced with the total duration when the level of drive signal is at level V exceeding the total duration when the level of the drive signal is at level 0.

The duration of the first temporal portion, and, hence, of the second temporal portion, of each illumination period depends on the voltage level of the corresponding sample of the input video signal 40.

FIG. 1K shows the effect of the spatial light modulator 12 on the direction of polarization of the light impinging on the analyzer 18. The direction of polarization is indicated by the absolute value of the angle $\alpha$ between direction of polarization of the light impinging on the analyzer and the direction of maximum transmissivity of the analyzer. The analyzer transmits light having an angle $\alpha$ close to zero and absorbs light having an angle $\alpha$ close to 90°.

FIG. 1L shows the modulation of the light source 20. The light source is ON throughout the illumination period of each display period, and is OFF during the following balance period.

FIG. 1M shows the light output from the exemplary pixel of the light valve 10 controlled by the pixel electrode 38. Light is output from the pixel only during the first temporal portion of the illumination period of each display period. No light is output during the second temporal portion of the illumination period. Moreover, no light is output during the balance period of the display period because the light source 20 is OFF during the balance period. The light source being OFF for only 30% of the display period, the non-DC-balanced operation substantially improves the perceived maximum brightness of the pixel by up to 40%, and similarly improves the brightness of any image generated by a display device incorporating such a non-DC-balanced light valve.

The disadvantage to operating in this type of non-DC-balanced mode is the rapid onset of pixel sticking. FIG. 2 is a graph showing the onset of pixel sticking over time in a light valve operating in a non-DC-balanced mode as described above. Substantial pixel sticking can be observed in the light valve within a half hour of this type of non-DC-balanced operation.

Consequently, there is a need for a ferroelectric spatial light modulator that can operate in a non-DC-balanced more for an extended period of time.

SUMMARY OF THE INVENTION

The invention provides a method of operating a ferroelectric liquid crystal-based spatial light modulator in a non-DC-Balanced mode. The method begins by providing a spatial light modulator including a transparent electrode, a pixellated electrode, and a ferroelectric liquid crystal layer sandwiched between the transparent electrode and the pixellated electrode. Next, the spatial light modulator is illuminated with a light source for an illumination time. Then, a portion of the pixellated electrode is set to a high drive signal voltage level during a first portion of illumination time, and set to a low drive signal voltage level during a second portion of the illumination time. Meanwhile, the transparent electrode is maintained at a first voltage potential between the high drive signal voltage level and the low drive signal voltage level during the first and second portions of illumination time. The first voltage potential may be midway between the low drive signal voltage level and the high drive signal voltage level. The high drive signal voltage level may be approximately 5 volts and the low drive signal voltage level may be approximately 0 volts.

The spaitial light modulator is then darkened for a darkened time. The transparent electrode voltage potential is then raised to a positive spiking voltage exceeding the first voltage potential for a first portion of the darkened time. This positive spiking voltage may also exceed the high drive signal voltage level and may be 6 volts. Next, the transparent electrode voltage potential is lowered to a negative spiking voltage below the first voltage potential for a second portion of the darkened time. The negative spiking voltage may be lower than the low drive signal voltage level and may be −6 volts. The method according to the invention then repeats itself beginning with the step of illuminating the spatial light modulator. Alternatively, the transparent electrode voltage potential may be raised to a positive spiking voltage exceeding the first voltage potential during a first dark time, and lowered to a negative spiking voltage below the first voltage potential during a subsequent dark time.

The method according to the invention may also provide that the transparent electrode voltage potential is raised to a second positive spiking voltage exceeding the first voltage potential for a third portion of the darkened time. Similarly, the method may also provide that the transparent electrode voltage potential is lowered to a second negative spiking voltage below the first voltage potential for a third portion of the darkened time.

The invention may further provide that when the transparent electrode voltage potential is raised to a positive spiking voltage exceeding the first voltage potential for a first portion of the darkened time, the portion of the pixellated electrode is set to the low drive signal voltage level. Likewise, when the transparent electrode voltage potential is lowered to a negative spiking voltage below the first voltage potential for a second portion of the darkened time, the portion of the pixellated electrode is set to the high drive signal voltage level.

Accordingly, the spatial light modulator uses a spiking scheme to extend the period it may operate before pixel sticking occurs. Other features and advantages of the present invention will become apparent from the following detailed description, taken in conjunction with the accompanying drawings, illustrating, by way of example, the principles of the invention.

BRIEF DESCRIPTION OF THE DRAWINGS

FIGS. 1B–1G illustrate the operation of the conventional reflective light valve shown in FIG. 1A in a first DC-balanced mode.

FIGS. 1H–1M illustrate the operation of the conventional reflective light valve shown in FIG. 1A in a non-DC-balanced mode.

DETAILED DESCRIPTION OF THE INVENTION

The invention is based on the inventors' discovery that applying a series of relatively large and fast changing electric fields across the ferroelectric liquid crystal layer of a spatial light modulator during the balance period of a non-DC-balanced mode greatly reduced pixel sticking as compared to using the balance period in an unsuccessful attempt to balance the electric fields.

Figure 1A:
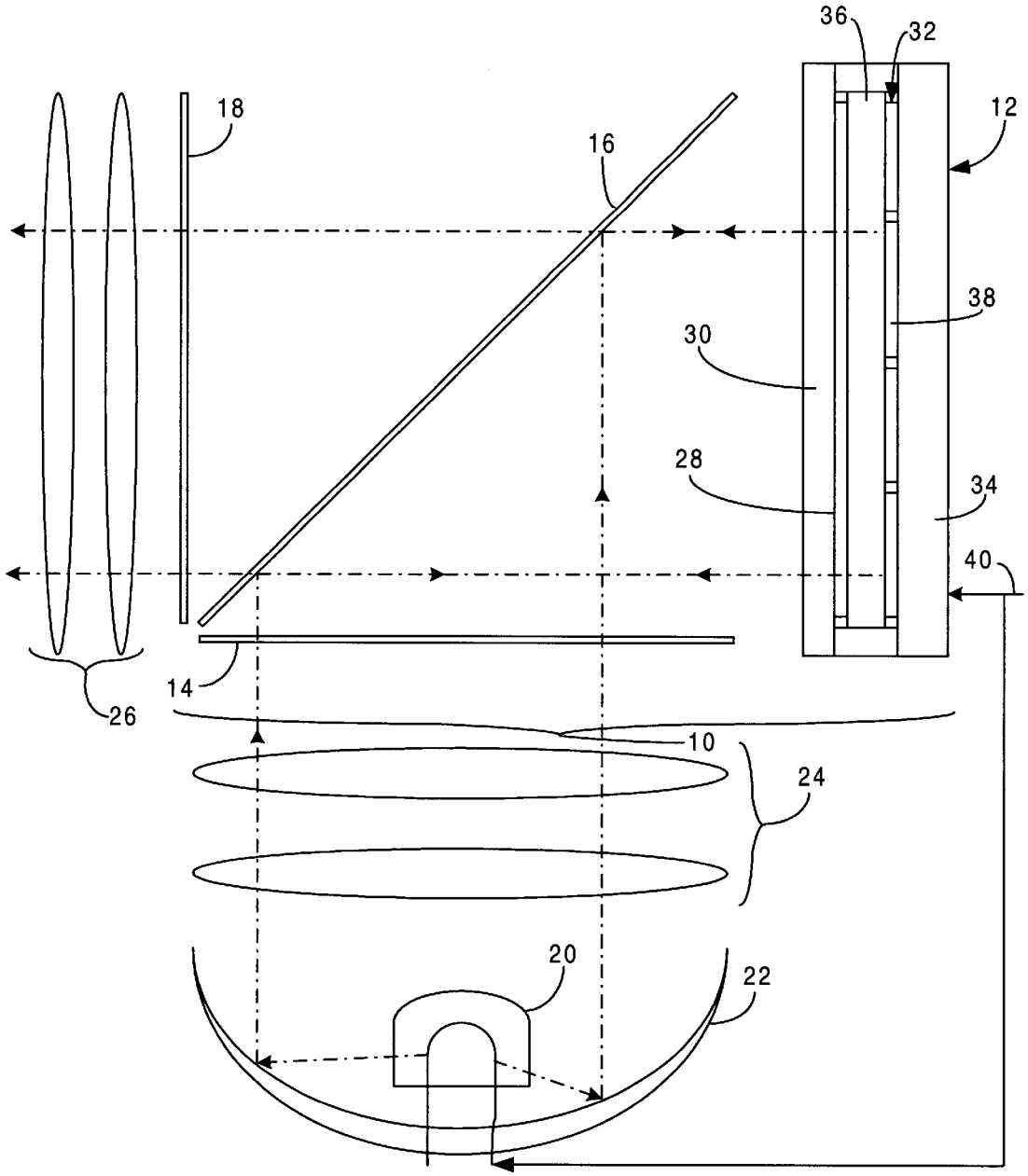
FIG. 1A (PRIOR ART)
FIG. 1A is a schematic diagram of part of a display device incorporating a conventional reflective light valve.
Figure 2:
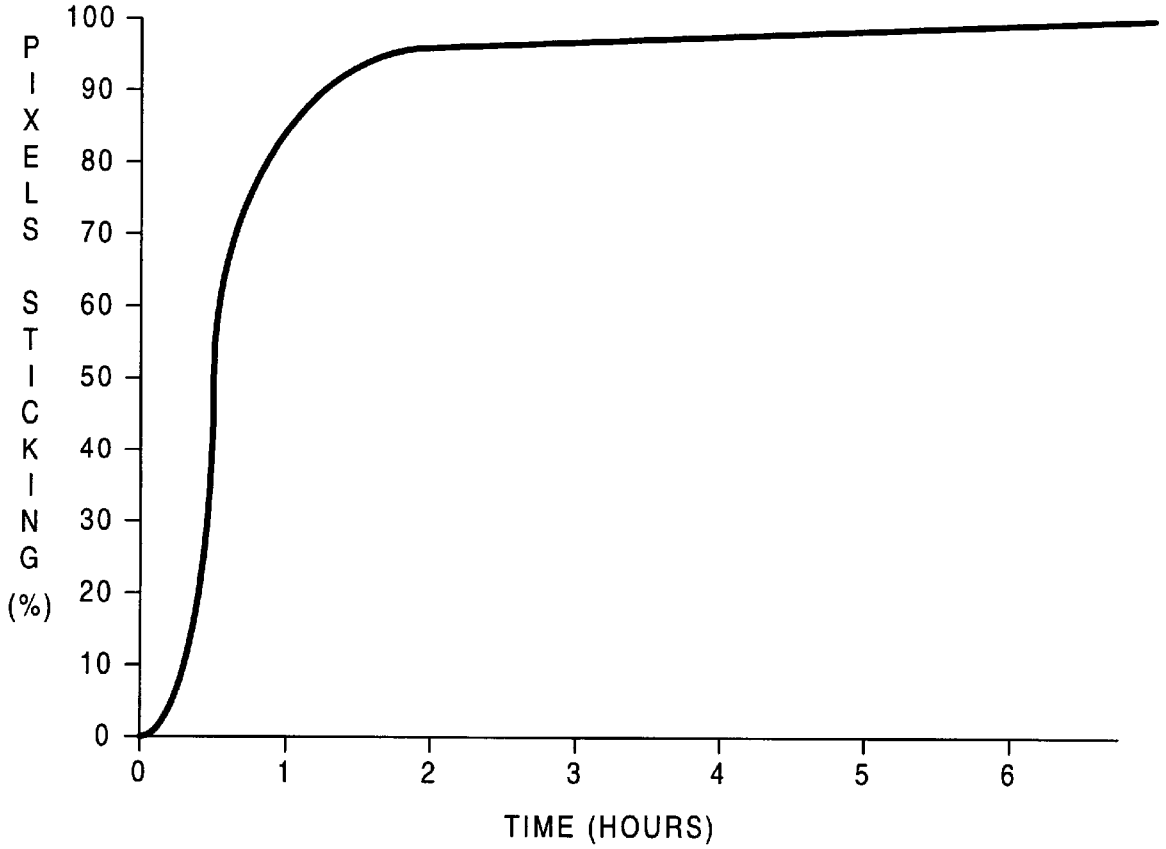
FIGURE 2 (PRIOR ART)
FIG. 2 is a graph indicating the level of pixel sticking over time with a conventional spatial light modulator operating in a non-DC-balanced mode.
Figures 3A, 3B, 3C, 3D, 3E, 3F:
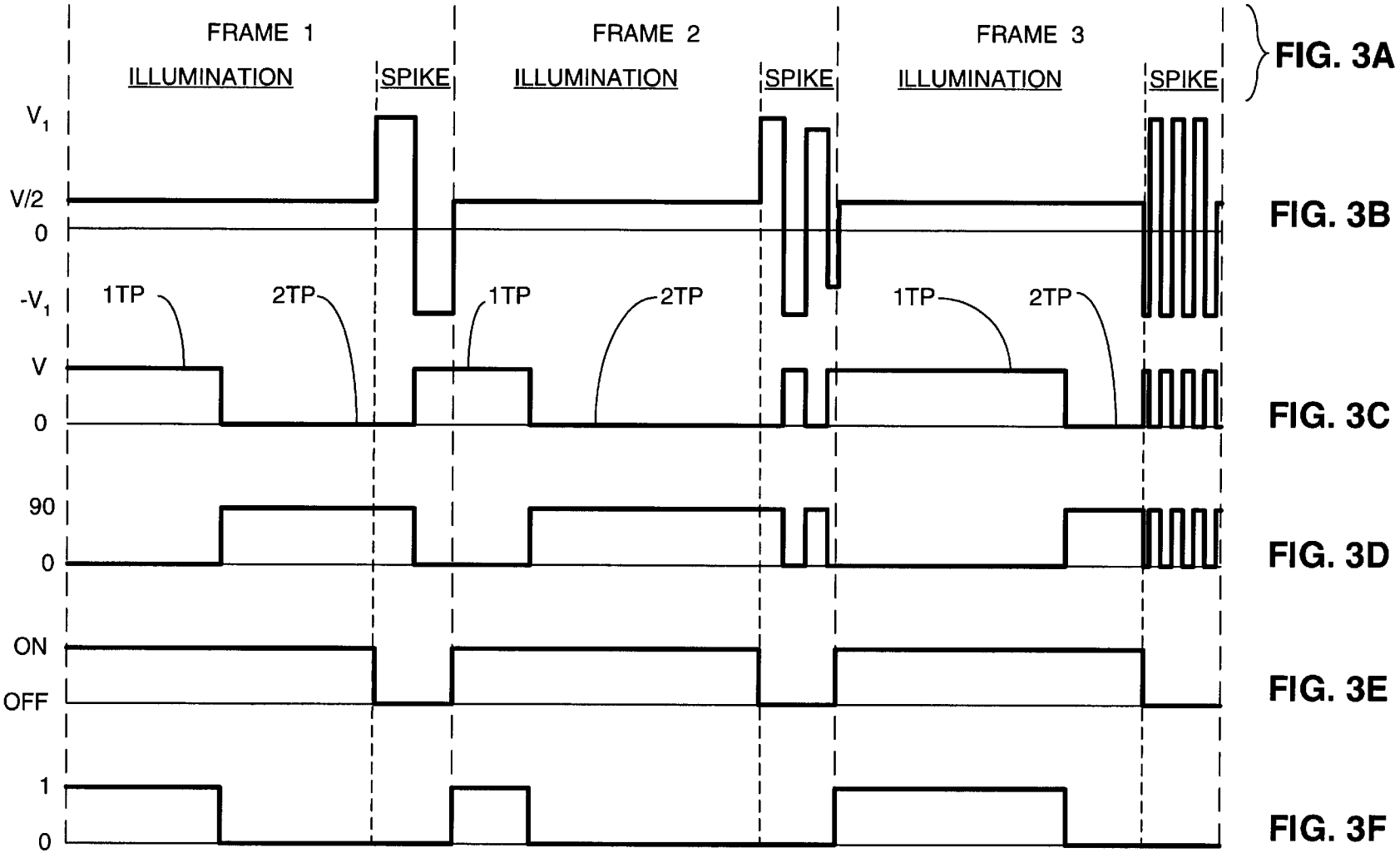
FIG. 3A–3F illustrate the operation of the conventional reflective light valve shown in FIG. 1A in a non-DC-balance mode with spiking.

FIGS. 3A–3F illustrate the operation of the exemplary pixel 38 of the conventional light valve 10 shown in FIG. 1A operating in a non-DC-balanced mode during three consecutive display periods. The remaining pixels operate similarly. In one embodiment of a conventional light valve, each display period corresponded to one frame of the input video signal 40. In another embodiment, each display period corresponded to a fraction of one frame of the input video signal. Each display period is composed of an illumination period (ILLUM) and a spiking period (SPIKE) having a substantially shorter duration than the illumination period, as shown in FIG. 3A. The duration of illumination period may be four or more times the duration of the spiking period.

FIG. 3B shows the voltage level applied to the transparent electrode 28. During the illumination period, the voltage applied is kept at a constant level of V/2. During the spiking period, however, the voltage is "spiked". This spiking can occur in a number of different ways, and three examples are shown in the Figure, one in each of the display periods.

In the first display period, the voltage applied to the transparent electrode is rapidly raised to a positive spiking voltage $V_1$. Roughly halfway through the spiking period, the voltage applied to the transparent electrode is rapidly dropped to a negative spiking voltage $-V_1$ before returning to the V/2 level for the next illumination period.

In the second display period, the voltage applied to the transparent electrode is again rapidly raised to a positive spiking voltage $V_1$, but roughly one quarter of the way through the spiking period is rapidly dropped to a negative spiking voltage $-V_1$. Roughly halfway through the spiking period, the voltage applied to the transparent electrode is once again raised, but this time to a positive spiking voltage below $V_1$. Finally, at roughly three quarters of the way through the spiking period, the voltage applied to transparent electrode is once again dropped, but this time to a negative spiking voltage level above $-V_1$ before returning to the V/2level for the next illumination period.

In the third display period, the voltage applied to the transparent electrode begins by rapidly dropping to the negative spiking voltage $-V_1$ before almost immediately rising to the positive spiking voltage $V_1$. This rapid oscillation between the negative spiking voltage $-V_1$ and the positive spiking voltage $V_1$ repeats until the spiking period ends and the voltage level returns to V/2for the next illumination period.

FIG. 3C shows the voltage applied to the exemplary pixel electrode 38. During the illumination period, changing the applied voltage from 0 to V reverses the direction of the electric field applied to the ferroelectric liquid crystal layer 36. The level of the drive signal is V for a first temporal portion 1TP of each illumination period. The level of the drive signal is 0 for the second temporal portion 2TP constituting the remainder of the illumination period. During the spiking periods, however, the voltage level of the exemplary pixel is set at its low drive signal level of zero volts when the level of the voltage applied to the transparent electrode is at or near the positive spiking voltage $V_1$. In addition, the voltage level of the exemplary pixel is set at its high drive signal level V when the level of the voltage applied to the transparent electrode is at or near the negative spiking voltage $-V_1$. This maximizes the voltage potential and the electric field applied in both directions across the ferroelectric liquid crystal material 36, postponing the onset of pixel sticking.

In the example shown, the duration of the first temporal portion 1TP of the drive signal is different in each of the three illumination periods. The duration of the first temporal portion, and, hence, of the second temporal portion, of each illumination period depends on the voltage level of the corresponding sample of the input video signal 40.

FIG. 3D shows the effect of the spatial light modulator 12 on the direction of polarization of the light impinging on the analyzer 18. The direction of polarization is indicated by the absolute value of the angle $\alpha$ between direction of polarization of the light impinging on the analyzer and the direction of maximum transmissivity of the analyzer. The analyzer transmits light having an angle $\alpha$ close to zero and absorbs light having an angle $\alpha$ close to 90°. in each display period, the angle $\alpha$ has values corresponding to the pixel being bright and dark for unequal times and operation is said to be in a non-DC-balance mode.

FIG. 3E shows the modulation of the light source 20. The light source is ON throughout the illumination period of each display period, and is OFF during the following spiking period. The OFF condition may be referred to as "darkening" and, for purposes of this description, may include not only a modulation of the light source, but also the modulation of the light generated by the light source at any point along an optical path including the spatial light modulator between the light source and the light output. Thus, the light may be said to be in the OFF condition and the spatial light modulator "dark" if the light reflected from the spatial light modulator is in some way prevented from forming an image at the light output. In such a case, the spatial light modulator would physically be illuminated, but would be said to be in the darkened condition correlating to the spiking period.

FIG. 3F shows the light output from the exemplary pixel of the light valve 10 controlled by the pixel electrode 38. Light is output from the pixel only during the first temporal portion of the illumination period of each display period. No light is output during the second temporal portion of the illumination period. Moreover, no light is output during the spiking period of the display period because the light source 20 is OFF during the spiking period. The light source being ON for substantially more than half the display period substantially improves the perceived maximum brightness of the pixel for a given light source 20 over the same light valve operating in a DC-balanced mode. Similarly, the image generated by a display device incorporating a light valve operating in a non-DC-balanced mode would be substantially brighter (nearly twice as bright) as the same display device incorporating a light valve operating in a DC-balanced mode. At the same time, the method according to the invention allows the light valve to function in the non-DC-balanced mode for greater periods without pixel sticking than was previously with the conventional non-DC-balanced ferroelectric liquid crystal-based spatial light modulator.

Figure 4:
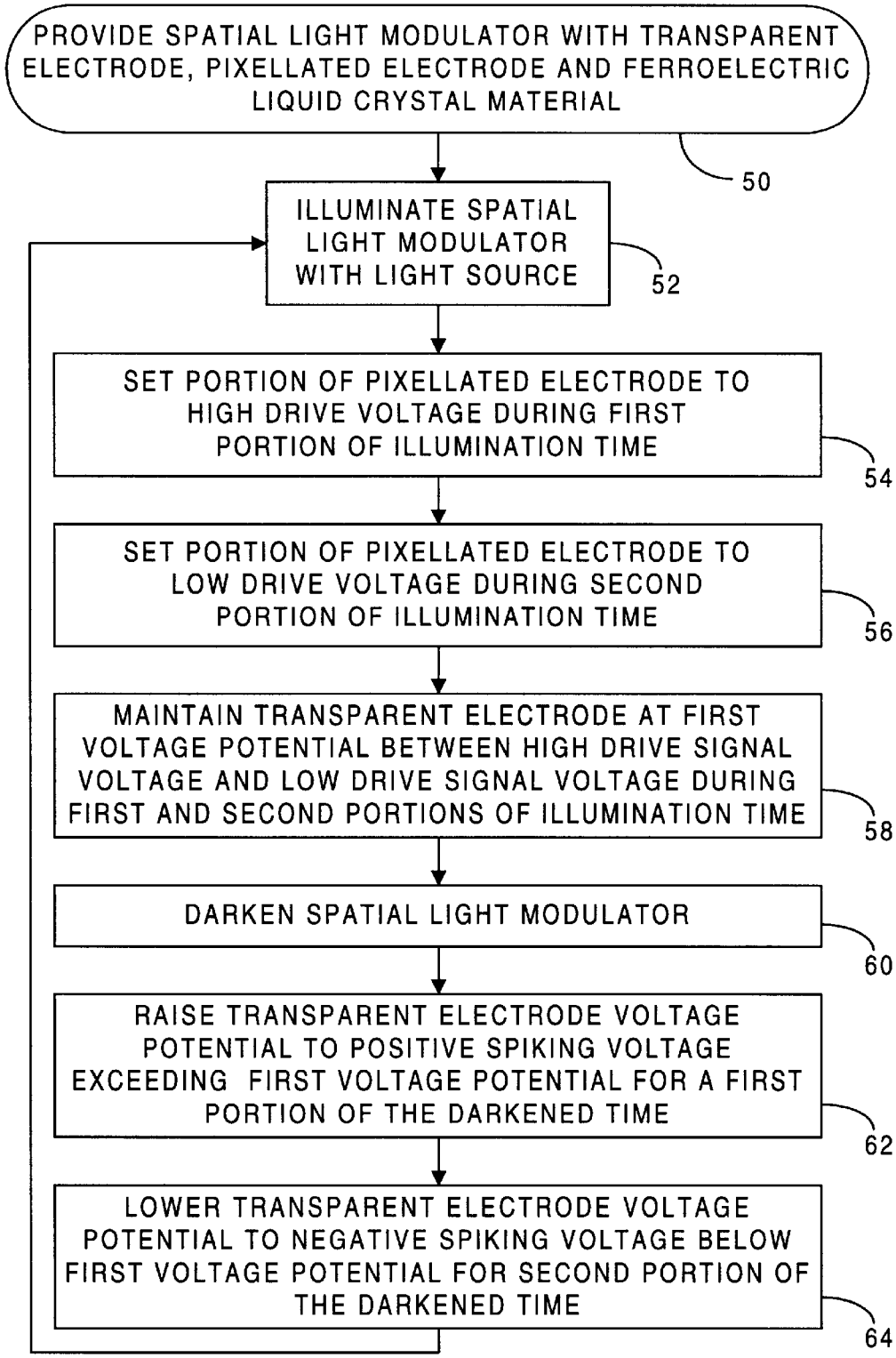
FIG. 4 is a flow-chart depicting the method according to the invention.

FIG. 4 is a flowchart depicting the method of operating a ferroelectric liquid crystal-based spatial light modulator in a non-DC-Balanced mode according to the invention. The method begins by providing a spatial light modulator including a transparent electrode, a pixellated electrode, and a ferroelectric liquid crystal layer sandwiched between the transparent electrode and the pixellated electrode (block 50). The manufacture of ferroelectric liquid crystal spatial light modulators is known in the art.

Next, the spatial light modulator is illuminated by a light source (block 52) for a total periodic duration called the illumination time (ILLUMINATION). The light source may be LEDs or any bright light source which can be modulated. The light may be colored or "white" light. The illumination may be direct, or reflected and may also be with the used of illuminating optics including lenses. The light generated by the light source is preferably polarized before illuminating the spatial light modulator.

Next, a portion of the pixellated electrode, representing a single pixel, is set at a high drive signal voltage level V during a first portion of illumination time (block 54). This high drive signal voltage corresponds to a pixel that will be providing a light output. The portion of the pixellated electrode, representing the single pixel, is also set to a low drive signal voltage level during a second portion of the illumination time (block 56). This low drive signal voltage corresponds to the dark segment of the illumination period that is used to produce grayscale in the output of the display.

While in the depicted examples the first portion of illumination time, when the drive signal voltage level is high, precedes the second portion of illumination time, when the drive signal voltage is low, this order of precedence is arbitrary and can be reversed. Alternatively, there may several individual durations when the drive signal voltage is high and several individual durations when the drive signal voltage is low during a single illumination period (not shown). The ratio of the overall duration of the drive signal voltage being high to the overall duration of the drive signal voltage being low during a single illumination period will determine the "grayness" of the pixel.

During the first and second portions of illumination time, the transparent electrode is maintained at a first voltage potential between the high and the low drive signal voltage levels (block 58) so that switching between the high and low drive signal voltage level will reverse the direction of an electric field across the liquid crystal layer 36. This first voltage level will preferably be at V/2, a point midway between the high and low drive signal voltage levels. Since the high and low drive signal voltage levels are typically 5 and 0 volts, respectively, the first voltage potential is typically at 2.5 volts.

Next, the spatial light modulator is darkened (block 60) for a total periodic duration called the darkened time (SPIKE). As discussed previously, this may not be a literal darkening of the spatial light modulator, but instead refers to a period of time when any image displayed by the spatial light modulator is hidden from a viewer. This is most often accomplished by modulating the light source itself, thus literally darkening the spatial light modulator, but can also be accomplished in any manner that prevents the light reflected from the spatial light modulator from forming an image. It is preferred that the illumination time be at least twice as long as the darkened time.

The transparent electrode voltage potential is then raised to a positive spiking a voltage exceeding the first voltage potential for a first darkened portion of the time (block 62). The positive spiking voltage preferably exceeds the high drive signal voltage level and is typically around 6 volts, but may be much larger. The transparent electrode voltage potential is then lowered to a negative spiking voltage below the first voltage potential for a second portion of the darkened time (block 64). The negative spiking voltage should be lower than the low drive signal voltage level and is typically around −6 volts, but may be much lower (larger magnitude).

The process of raising and lowering the voltage of the transparent electrode to the positive and negative spiking voltages is called "spiking". The order of performing the steps of raising the transparent electrode voltage potential and lowering the transparent electrode voltage potential does not appear to be critical. For example, in FIG. 3B the step of raising the transparent electrode voltage potential is performed first in Frame 1 and Frame 2, but the step of lowering the transparent electrode voltage potential is performed first in Frame 3.

In addition, as can be seen in FIG. 3B, Frames 2 and 3, these steps can be repeated several times during a single darkened time (SPIKE) and the magnitude of the positive and negative spiking voltage can be increased or attenuated as the steps repeat. An example of attenuation of the positive and negative spiking voltage is shown in FIG. 3B, Frame 2.

It is also not necessary that the number of times the voltage potential of the transparent electrode is raised to the positive spiking voltage match the number of times the voltage potential of the transparent electrode is lowered to the negative spiking voltage, and vise versa. Thus, as depicted in FIG. 3, Frame 3, the voltage potential of the transparent electrode may be lowered to the negative spiking voltage more times than it is raised to the positive spiking voltage during the darkened time (SPIKE).

It is also possible that the voltage of the transparent electrode may be alternately raised to the positive spiking voltage for an entire darkened time and lowered to the negative spiking voltage for en entire subsequent darkened time in adjacent display periods.

It is also desirable, but not necessary, that the portion of the pixellated electrode be set to the high drive signal voltage when the transparent electrode is at or near the negative spiking voltage. This maximizes the electric field across the ferroelectric liquid crystal layer 36. Similarly, it is desirable but not necessary that the portion of the pixellated electrode be set to the low drive signal voltage when the transparent electrode is at or near the positive spiking voltage in order to maximize the reverse electric field across the ferroelectric liquid crystal layer 36. This technique has been found to further delay the onset of pixel sticking.

The process, starting with the step of illuminating the spatial light modulator, then repeats itself as successive frames are displayed by the spatial light modulator.

Figure 5:
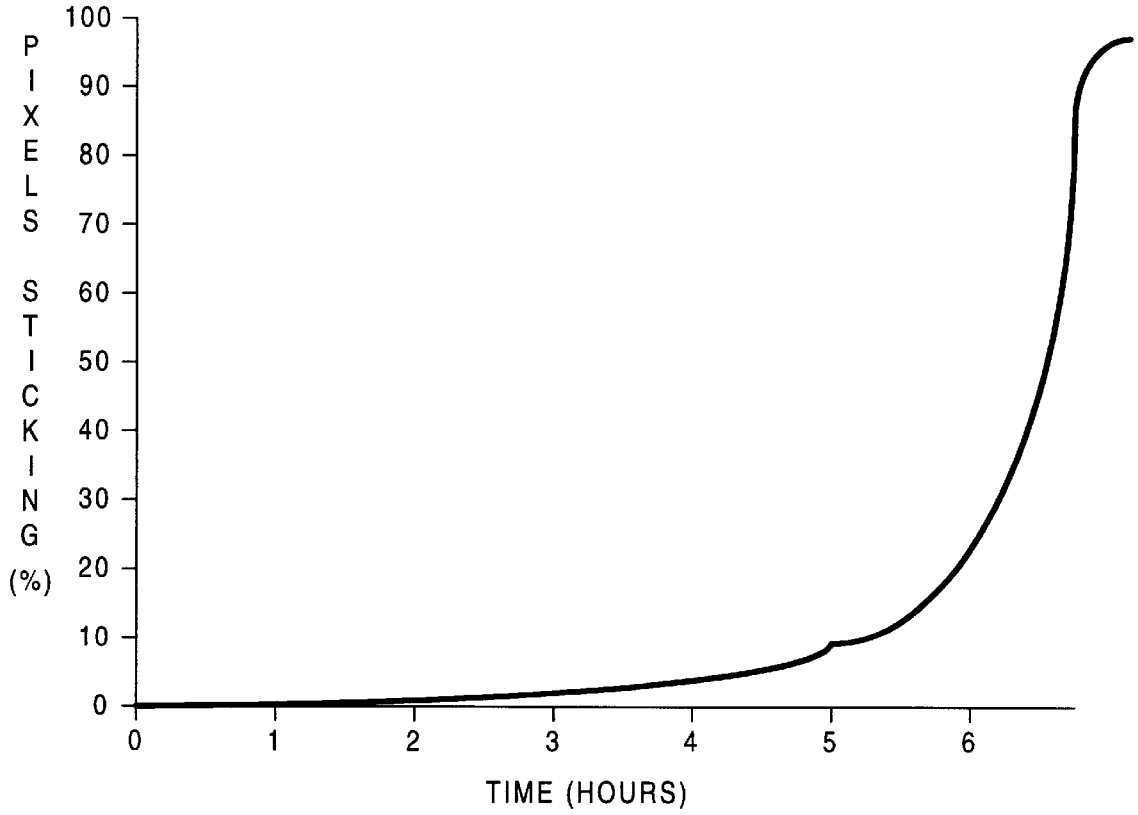
FIG. 5 is a graph indicating the level of pixel sticking over time with a conventional spatial light modulator operating in a non-DC-balanced mode with spiking according to the invention.

FIG. 5 is a graph showing the onset of pixel sticking over time in a light valve operating in a non-DC-balanced mode with spiking according to the invention. The graph indicates that the onset of sticking is delayed by about an order of magnitude over operating in a non-DC-balanced mode according to the prior art. In addition, it appears that increasing the temperature of the spatial light modulator further delays the onset of pixel sticking.

Although this disclosure describes illustrative embodiments of the invention in detail, it is to be understood that the invention is not limited to the precise embodiments described, and that various modifications may be practiced within the scope of the invention defined by the appended claims.

We claim:

1. A method of operating a ferroelectric liquid crystal-based spatial light modulator in a non-DC-Balanced mode, the method comprising:

A) providing a spatial light modulator including a transparent electrode, a pixellated electrode, and a ferroelectric liquid crystal layer sandwiched between the transparent electrode and the pixellated electrode;

B) illuminating the spatial light modulator with a light source;

C) setting a portion of the pixellated electrode to a high drive signal level during a first portion of illuminated time;

D) setting the portion of the pixellated electrode to a low drive signal level during a second portion of illuminated time;

E) maintaining the transparent electrode at a first voltage potential between the high drive signal and the low drive signal during the first and second portions of illuminated time;

F) darkening the spatial light modulator;

G) setting the voltage of the transparent electrode voltage potential to a positive spiking voltage exceeding the first voltage potential for a first portion of darkened time;

H) lowering the transparent electrode voltage potential to a negative spiking voltage below the first voltage potential for a second portion of darkened time; and I) repeating steps B) through I).

2. A method as in claim 1, additionally comprising after step H) and before step I):

raising the transparent electrode voltage potential to a second positive spiking voltage exceeding the first voltage potential for a third portion of darkened time.

3. A method as in claim 1, in which step H) occurs before step G) and additionally comprising after step G) and before step I):

lowering the transparent electrode voltage potential to a second negative spiking voltage below the first voltage potential for a third portion of darkened time.

4. A method as in claim 1, in which step G) additionally includes:

setting the portion of the pixellated electrode to the low drive signal level.

5. A method as in claim 4, in which step H) additionally includes:

setting the portion of the pixellated electrode to the high drive signal level.

6. A method as in claim 1, in which step F) includes darkening the spatial light modulator for a period of darkened time equal to less than half a duration of illumination time.

7. A method as in claim 1, in which step G) is performed prior to step H) when the first portion of illuminated time exceeds the second portion of illuminated time.

8. A method as in claim 1, in which step H) is performed prior to step G) when the second portion of illuminated time exceeds the first portion of illuminated time.

9. A method as in claim 1, in which the positive spiking voltage of step G) exceeds the high drive signal level of step C).

10. The method as in claim 9, in which the positive spiking voltage of step G) is approximately 6 volts.

11. A method as in claim 1, in which the negative spiking voltage of step H) is lower that the low drive signal level of step D).

12. The method as in claim 11, in which the negative spiking voltage of step H) is approximately −6 volts.

13. A method as in claim 1, in which the first voltage potential of step E) is at a level halfway between the high drive signal voltage level and the low drive signal voltage level.

14. The method as in claim 13, in which the high drive signal is approximately 5 volts and the low drive signal is approximately 0 volts.

15. A method of operating a ferroelectric liquid crystal-based spatial light modulator in a non-DC-Balanced mode, the method comprising:

A) providing a spatial light modulator including a transparent electrode, a pixellated electrode, and a ferroelectric liquid crystal layer sandwiched between the transparent electrode and the pixellated electrode;

B) illuminating the spatial light modulator with a light source;

C) setting a portion of the pixellated electrode to a high drive signal level during a first portion of illuminated time;

D) setting the portion of the pixellated electrode to a low drive signal level during a second portion of illuminated time;

E) maintaining the transparent electrode at a first voltage potential between the high drive signal and the low drive signal during the first and second portions of illuminated time;

F) darkening the spatial light modulator;

G) setting the voltage of the transparent electrode voltage potential to one of a positive spiking voltage exceeding the first voltage potential and a negative spiking voltage below the first voltage potential;

H) illuminating the spatial light modulator with a light source;

I) setting a portion of the pixellated electrode to a high drive signal level during a first portion of illuminated time;

J) setting the portion of the pixellated electrode to a low drive signal level during a second portion of illuminated time;

K) maintaining the transparent electrode at the first voltage potential between the high drive signal and the low drive signal during the first and second portions of illuminated time;

L) darkening the spatial light modulator;

M) setting the voltage of the transparent electrode voltage potential to the other of a positive spiking voltage exceeding the first voltage potential and a negative spiking voltage below the first voltage potential; and N) repeating steps B) through N).

16. A method of operating a light valve, the light valve including a spatial light modulator ("SLM") that is operated in a non-DC-Balanced mode, the spatial light modulator including a transparent electrode, a plurality of pixel electrode, and a ferroelectric liquid crystal layer between the transparent and pixel electrodes, the method comprising:

a) during an illumination period, 1) applying a first voltage to the transparent electrode during the illumination period, wherein said first voltage is between a second voltage and a third voltage;

2) projecting light towards the pixel electrodes;

3) for at least a portion of the illumination period, applying the second voltage to a first set of the pixel electrodes in order to change the polarization of light incident upon the first set of the pixel electrodes, while applying the third voltage to a second set of the pixel electrodes in order to leave unchanged the polarization of light incident upon the second set of the pixel electrodes;

4) outputting from the light valve only one of (i) light that has its polarization changed and (ii) light that has its polarization unchanged;

b) during a balance period, 1) applying to the transparent electrode a positive spiking voltage exceeding the first voltage potential for a first portion of the balance period;

2) applying to the transparent electrode a negative spiking voltage below the first voltage potential for a second portion of the balance period.

* * * * *